United States Patent [19]

Williams

[11] Patent Number: 4,679,888

[45] Date of Patent: Jul. 14, 1987

[54] ELECTRICAL TERMINAL AND A METHOD OF MAKING IT

[75] Inventor: Tom R. Williams, Elizabethtown, Pa.

[73] Assignee: AMP Incorporated, Harrisburg, Pa.

[21] Appl. No.: 345,956

[22] Filed: Feb. 5, 1982

[51] Int. Cl.[4] ..... H01R 4/30

[52] U.S. Cl. ..... 439/883; 439/801

[58] Field of Search ..... 339/229, 230 R, 230 C, 339/231, 263 R, 263 B, 277 R, 277 C

[56] References Cited

U.S. PATENT DOCUMENTS

| | | | |
|---|---|---|---|
| D. 123,589 | 11/1940 | Eden | 339/230 R |
| 631,970 | 8/1899 | Schwedtmann | 339/272 R |
| 1,233,197 | 7/1917 | Cuthbert | 339/277 R |
| 3,771,111 | 11/1973 | Pritulsky | 339/223 R |
| 4,002,390 | 1/1977 | Perry et al. | 339/263 R |
| 4,362,351 | 12/1982 | Wible | 339/263 R |

FOREIGN PATENT DOCUMENTS

| | | | |
|---|---|---|---|
| 2054984 | 2/1981 | United Kingdom | 339/230 R |

*Primary Examiner*—Gil Weidenfeld
*Assistant Examiner*—Gary F. Paumen
*Attorney, Agent, or Firm*—Allan B. Osborne

[57] ABSTRACT

An electrical terminal is disclosed having the wire barrel and tongue portion bent at ninety degrees one to the other. Further, the tongue includes means thereon to prevent terminal rotation about the receiving stud. A method of making the terminal is also disclosed.

1 Claim, 10 Drawing Figures

ELECTRICAL TERMINAL AND A METHOD OF MAKING IT

BACKGROUND OF THE INVENTION

1. The Field Of The Invention

The invention disclosed herein is an electrical terminal for connecting a wire to a stud or the like on a transformer or other installation.

2. The Prior Art

The contemporary electrical terminal is cast from copper and has a stud-receiving tongue formed at ninety degrees to the wire-receiving means. Means to prevent rotation is a groove extending across the tongue. Opposing sides on the stud bear against the sidewalls defining the groove.

SUMMARY OF THE INVENTION

The invention disclosed herein comprises an elongated tube of conductive material from which is stamped and formed an electrical connector having a cylindrical, wire-receiving means at one end and a flat stud-receiving means at another end with the two ends being ninety degrees one from the other. Further, the stud-receiving means includes an anti-rotational device thereon to prevent the terminal being rotated about the stud.

DESCRIPTION OF THE INVENTION

Figures 1, 2, 3, 4:
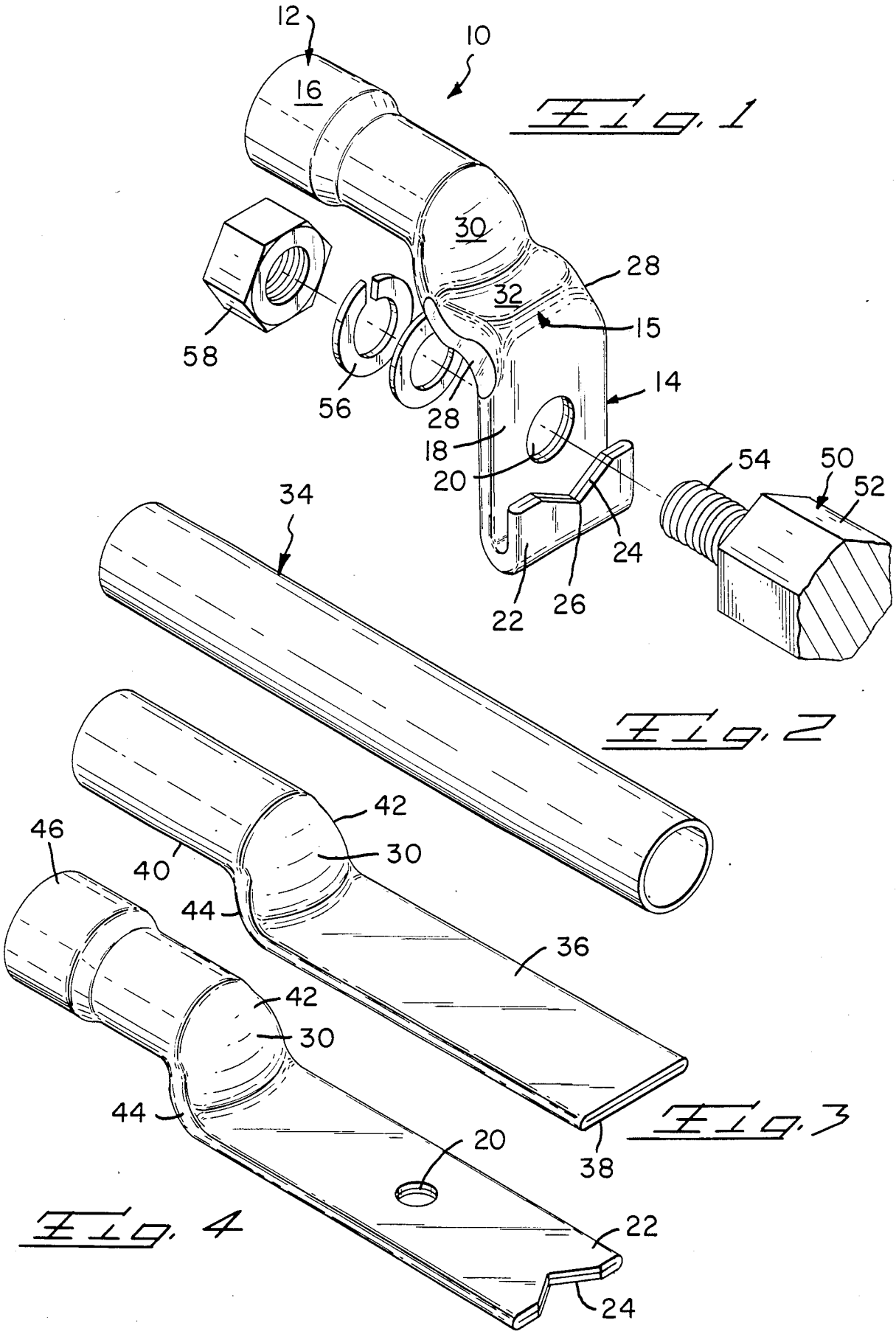
FIG. 1 is a perspective view of the electrical terminal constructed in accordance with the preferred embodiment of the present invention.
FIGS. 2 through 6 are perspective views illustrating the stamping and forming steps in fabricating the electrical terminal of FIG. 1.

Electrical terminal 10, shown in FIG. 1, has wire receiving means 12 at one end and stud-receiving means 14 at the opposite end. The two lie at ninety degrees one from the other by virtue of the connecting strap 15 being bent intermediate the two ends.

Wire receiving means 12 includes the cylindrical, closed wire barrel 16 shown in the drawings. As is well known in the art, the barrel receives a bared end of a wire or cable (not shown) which is secured therein by the barrel walls being compressed or crimped inwardly against the wire. Other means for securing the wire; e.g., solder, can be used. Other wire receiving devices; e.g., an open barrel, can be formed in lieu of the closed barrel shown.

Stud-receiving means 14 includes a tongue 18 through which opening 20 has been located. Free end 22 of the tongue has been stamped to provide a V-end 24 and has been bent back 180 degrees so that V-end 24 faces and is adjacent to opening 20. The point where the two legs of the V meet, indicated by reference numeral 26, is in alignment with the center of opening 20.

Simply bending the terminal to provide an angled terminal is unacceptable because such a bend cannot sustain flexing. Accordingly, after being bent, the sides 28 of the connecting strap 15 are turned down to strengthen the bend and resist flexing. The turned down edges extend from the closed front end 30 of wire barrel 16 to tongue 18. The edges are curved or turned down from about fifty degrees to eighty degrees relative to the flat surface 32 of strap 15 located immediately in front of closed front end 30.

A method of making terminal 10 is shown in FIGS. 2 through 6. FIG. 2 illustrates a tube 34 of a suitable conductive material. With regard to the terminals made in accordance with the present invention, the material used was annealed copper.

One end of the tube is flattened as indicated by reference numeral 36. In flattening the one end it is vertically displaced so that it's lower surface 38 is essentially on the same horizontal plane as the lower surface 40 of the cylindrical other end. The flattening further is done so that the surface of closed front end 30 is convex from one side 42 to the opposite side 44.

FIG. 4 shows opening 20 having been punched through the flattened end, free end 22 being provided with V-end 24 and the opposite end; i.e., wire-receiving means 12, being belled out as indicated by reference numeral 46.

Figure 5:
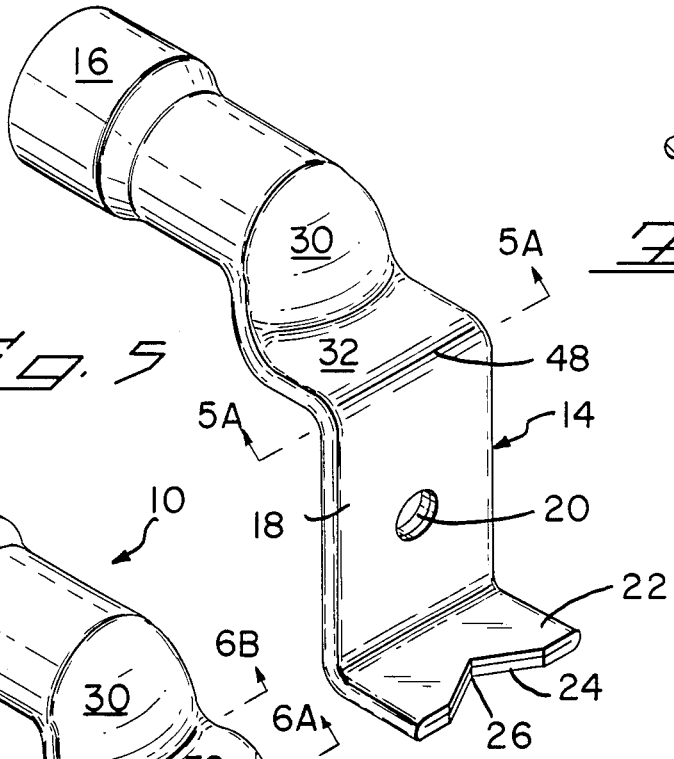
Figure 5A:
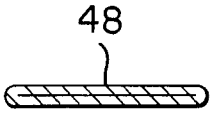
Figure 6:
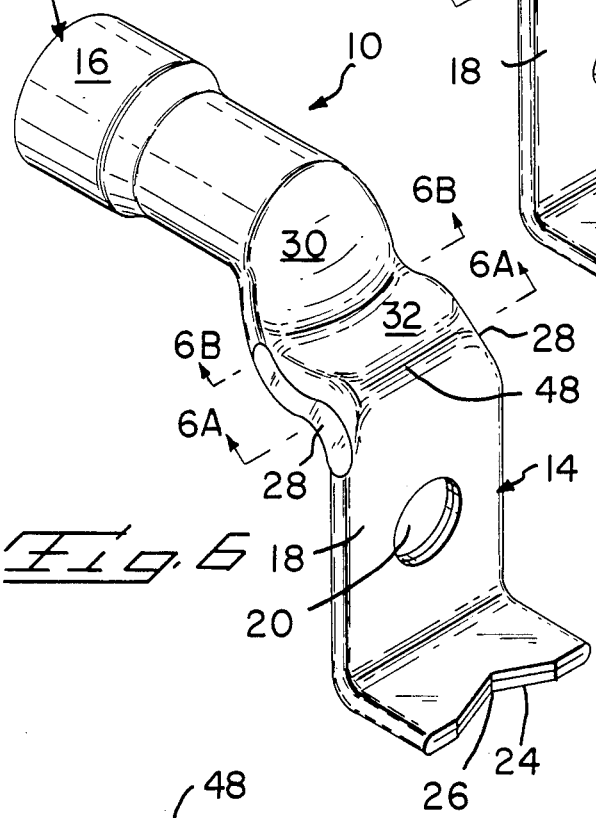

Connecting strap 15 is bent ninety degrees at bend site 48 and free end 22, is similarly bent near opening 20, both operations being shown in FIG. 5. FIG. 5A is a cross-sectional view taken along line 5A—5A in FIG. 5. This view shows that the strap sides at this stage, have not been turned down. FIG. 6, the next step, is where the sides are turned down. The degree the sides are turned is greater at bend site 48.

Figure 6A:
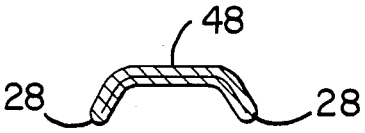
Figure 6B:
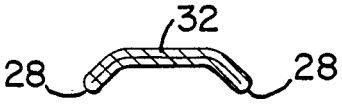

The cross-sectional drawings in FIGS. 6A and 6B, taken along lines 6A—6A and 6B—6B in FIG. 6, show the difference. Maximum strength is thus provided at the weakest point.

The final step, which may be preformed earlier, is bending free end 22 another ninety degrees so that V-end 24 faces opening 20.

FIG. 1 shows stud 50 having a hexagonal section 52 and threaded end 54. Washer 56 and nut 58 are also shown.

Figure 7:
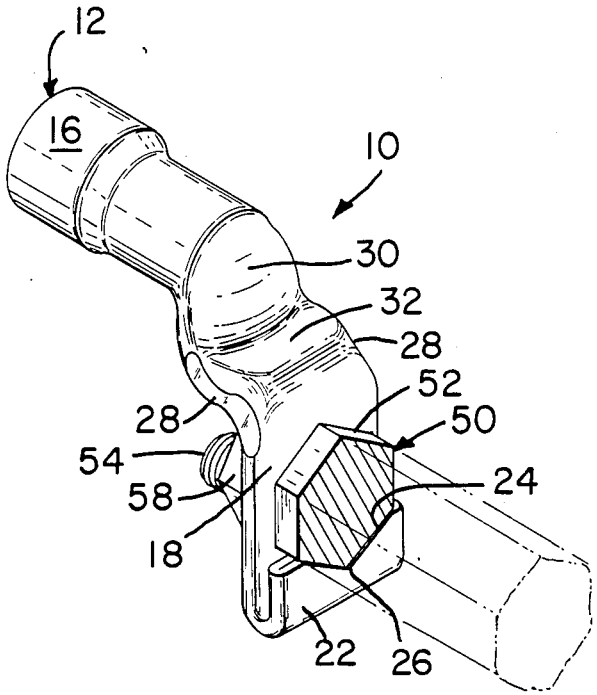
FIG. 7 shows the electrical terminal of FIG. 1 mounted on a stud.

FIG. 7 shows terminal 10 mounted on stud 50 with the hexagonal section 52 being received between the two legs of V-end 24. Nut 58 and washer 56, mounted on threaded end 54 secure the terminal to the stud with the hexagonal section 52 and V-end 24 cooperating to prevent the terminal from being rotated about the stud.

The present invention may be subject to many modifications and changes without departing from the spirit or essential characteristics thereof. The present embodiment is therefore intended in all respects as being illustrative and not restrictive of the scope of the invention.

What is claimed is:

1. A stamped and formed electrical terminal comprising an elongated length of tubing with one end providing a cylindrical wire receiving means and the other end being flattened and bent ninety degrees relative to the wire receiving means and having an opening therethru to receive an electrical stud and further with the free end being V-shaped and bent back to face the opening, said V-shaped free end adapted to cooperate with a hexagonal-headed stud which may be positioned in the opening to prevent the terminal from rotating about the stud.

* * * * *